United States Patent [19]

Mowbray

[11] 4,320,733

[45] Mar. 23, 1982

[54] FUEL PUMPING APPARATUS

[75] Inventor: Dorian F. Mowbray, Burnham, England

[73] Assignee: Lucas Industries Limited, Birmingham, England

[21] Appl. No.: 165,675

[22] Filed: Jul. 3, 1980

[30] Foreign Application Priority Data

Aug. 4, 1979 [GB] United Kingdom ..... 27270/79

[51] Int. Cl.[3] ..... F02M 59/20

[52] U.S. Cl. ..... 123/501

[58] Field of Search ..... 123/501, 502; 123/500, 123/503; 417/462

[56] References Cited

U.S. PATENT DOCUMENTS

| | | | |
|---|---|---|---|
| 3,024,779 | 3/1962 | Hogeman | 123/501 |
| 3,177,860 | 4/1965 | Glikin | 123/502 |
| 4,050,432 | 9/1977 | Davis et al. | 123/502 |
| 4,177,775 | 12/1979 | Hofer et al. | 123/502 |

FOREIGN PATENT DOCUMENTS

| | | | |
|---|---|---|---|
| 55-37509 | 3/1980 | Japan | 123/501 |

*Primary Examiner*—Ira S. Lazarus
*Assistant Examiner*—Magdalen Moy

[57] ABSTRACT

A fuel injection pumping apparatus of the rotary distributor type has an angularly adjustable cam ring to which is connected an arm. The arm is engaged by a surface on a linearly movable actuating member the position of which varies in accordance with the speed of the associated engine. The arm is also engaged with a cam connected to an operator adjustable member which is also coupled to an arrangement for controlling the amount of fuel supplied by the apparatus. The arrangement is such that movement of the operator controlled member effects an immediate adjustment of the timing of fuel delivery, the timing also varying as a result of speed variation.

7 Claims, 5 Drawing Figures

FUEL PUMPING APPARATUS

This invention relates to a fuel injection pumping apparatus for supplying fuel to an internal combustion engine and comprising a rotary member adapted to be driven in use, in timed relationship with the associated engine, a plunger located in a bore formed in the rotary member, an angularly adjustable cam member for imparting inward movement to the plunger as the rotary member rotates, means for conveying fuel displaced from said bore to an outlet, said cam being angularly movable to vary the timing of delivery of fuel from said bore, a shuttle movable in a cylinder to displace fuel from the cylinder to the bore to effect outward movement of the plunger and means for controlling the displacement of the shuttle thereby to vary the amount of fuel supplied to the outlet during inward movement of the plunger.

Such apparatus is known in the art and in the past the adjustment of the angular position of the cam member has been effected by fluid pressure operable means in the form of a piston connected to the cam member and subjected to a variable fluid pressure. The piston being connected to the cam member is subjected to a fluctuating force due to the reaction between the plunger and the cam member and it has been the practice to provide a check valve at the entrance to the cylinder containing the piston. The duty of the check valve is to try to prevent rapid escape of fluid from the cylinder so that the piston and cam member are held against movement by the cam reaction. The valve must however be constructed so that escape of fluid at a lower rate can take place during the periods when there is no cam reaction. The high pressure generated in the cylinder by the cam reaction and its duration, vary with the speed at which the apparatus is driven and with the amount of fuel being supplied by the apparatus. As a result the inevitable leakage through the valve and the working clearance between the piston and cylinder varies. This means that the position of the cam member cannot be precisely controlled.

The fluid pressure required to act upon the piston is usually derived from a low pressure fuel pump located in the apparatus. The output pressure of the pump usually varies in accordance with the speed at which the apparatus is driven so that the position of the cam member and the timing of delivery varies with speed. It is often required however that the timing of delivery should also be varied in accordance with some other parameter for example, the amount of fuel being delivered to the associated engine. In the past it has been the practice to modify the force exerted on the piston in accordance with the change in the value of the aforesaid parameter. The modification of the force exerted on the piston can be obtained in a number of ways. For example the force exerted by a spring on the piston can be varied or the piston may be subjected to another fluid pressure which varies in accordance with the aforesaid parameter. Alternatively the pressure applied to the piston and which varies in accordance with the speed, is further modified in accordance with the variation in the value of said parameter. This variation is not always easy to achieve and often involves a loss of fuel from the low pressure pump. This means that the capacity of the low pressure pump must be increased so that it can always supply sufficient fuel to meet the demand of the associated engine. A further problem is that the pressure applied to the piston takes some time to alter when the aforesaid parameter has changed. As a result the timing of delivery of fuel will be incorrect for a short time and this can cause exhaust emission problems. The object of the present invention is to provide an apparatus of the kind specified in a simple and convenient form.

According to the invention an apparatus of the kind specified comprises an arm pivotally connected to and extending from said cam member in a plane generally perpendicular to the axis of rotation of said rotary member, an actuating member movable along an axis generally at right angles to said plane, a shaped surface defined on said actuating member for engagement by said arm whereby as the actuating member is moved axially angular movement will be imparted to the arm and the cam member, means responsive to the speed at which the apparatus is driven for varying the axial setting of said actuating member and an adjustable cam engageable with said arm at a position removed from its pivotal connection with the cam member, the setting of said adjustable cam being dependent upon the setting of an operator adjustable control.

The apparatus will now be described in greater detail with reference to the accompanying drawings in which.

Figure 1:
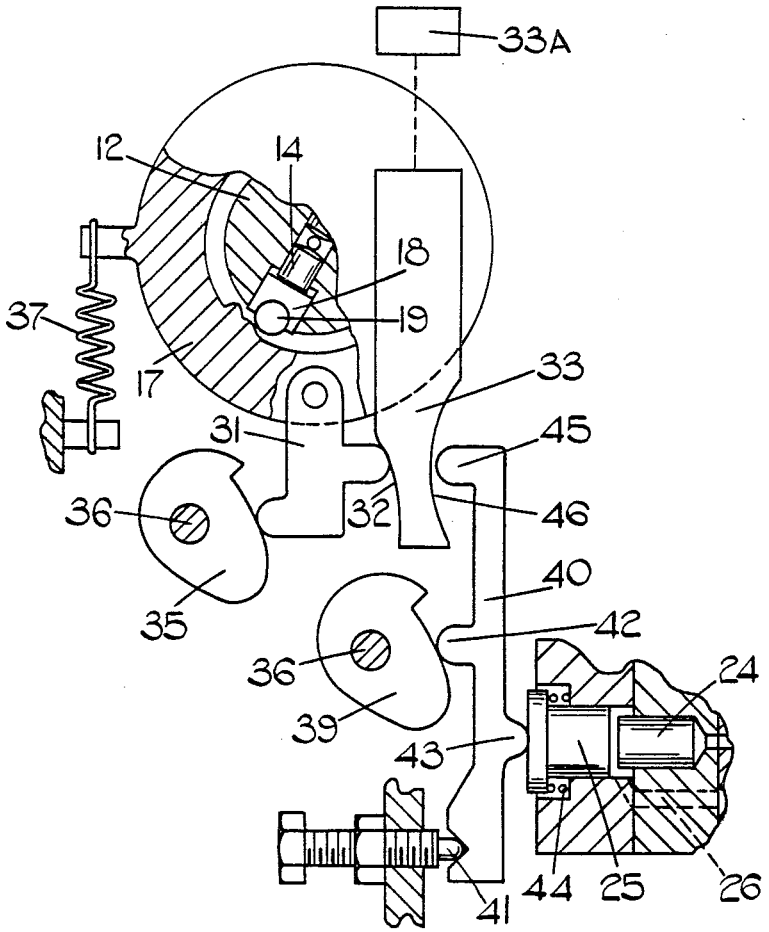
FIG. 1 is a diagrammatic representation of part of the apparatus.
Figure 3:
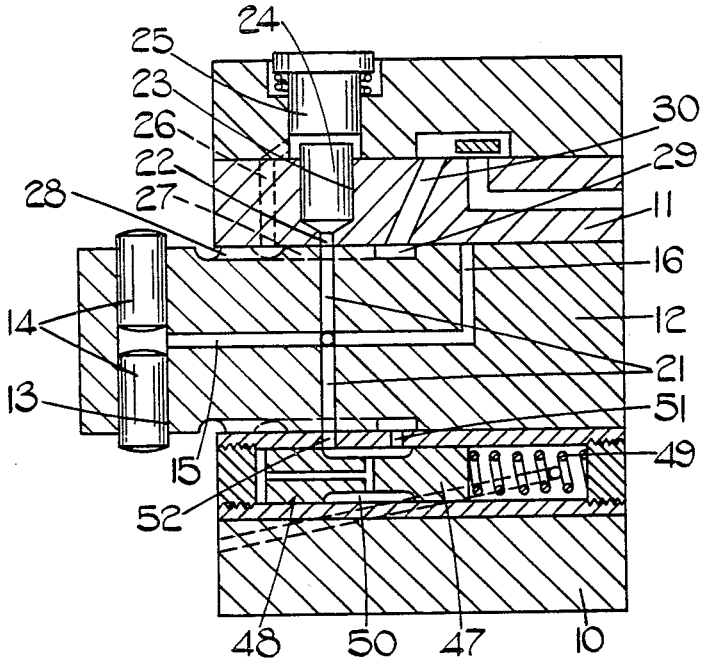
FIG. 3 is a sectional side elevation through part of the apparatus not shown in FIG. 1.

Referring to FIGS. 1 and 3 of the drawings, the apparatus comprises a housing 10 in which is located a sleeve 11 mounting a rotary cylindrical member 12 hereinafter called the distributor member, which is adapted to be driven in timed relationship with the associated engine by means of a drive shaft (not shown). The distributor member 12 is provided with a transversely extending bore 13 in which is located a pair of pumping plungers 14. The bore 13 communicates with a longitudinal passage 15 which at one position, communicates with an outwardly extending delivery passage 16 which is arranged to register in turn and as the distributor member rotates with a plurality of outlet ports (not shown) which in use are connected to the injection nozzles respectively of the associated engine. The communication between the delivery passage and one of the outlet ports takes place the whole time the plunger 14 is moved inwardly.

For effecting inward movement of the plungers and as shown in FIG. 1, there is provided an annular cam member in the form of a ring 17 which surrounds the distributor member. The plungers 14 at their outer ends, are engaged by shoes 18 which carry rollers 19 engageable with the internal peripheral surface of the cam ring. The cam ring on its internal surface is provided with a plurality of pairs of cam lobes one of which is indicated at 20 and these lobes as the distributor member rotates, engage with the rollers 19 to impart inward movement thereto. Following the inward movement of the plungers during which fuel is displaced to an outlet, the distributor member rotates and one of a plurality of inlet passages 21 which communicate with the longitudinal passage 15, are brought into register with an inlet port 22 which is formed in the sleeve 11. Whilst this communication is taking place, a measured quantity of fuel flows through the inlet port 22 and the plungers are displaced outwardly by an appropriate amount.

The port 22 is formed at one end of a cylinder 23 which contains an axially movable shuttle 24. The outward movement of the shuttle 24 is determined by a stop 25. The stop 25 is adjustable to determine the extent of movement of the shuttle 24 and the way in which the adjustment of the stop is obtained will be described later in this specification.

Fuel is supplied to the outer end of the cylinder 23 to effect inward movement of the shuttle 24 to displace the measured amount of fuel to the inlet port 22. The flow of fuel to the outer end of the cylinder takes place by way of a passage 26 formed in the sleeve 11 and which terminates in a port opening onto the periphery of the distributor member. The port can register in turn with a first series of longitudinal grooves 27 formed in the periphery of the distributor member and equi-angularly spaced there about. The grooves 27 are alternately disposed relative to the ends of the passages 21 and communicate with a circumferential groove 29 formed in the distributor member and in constant communication with a supply passage 30. Moreover, the port formed at the end of the passage 26 can register in turn with a second series of longitudinal grooves 28. These grooves are also equi-angularly spaced about the axis of the distributor member and coincide with the ends of the passages 21 respectively. Grooves 28 communicate with a space defined within the housing which space communicates with a drain.

The supply passage 30 is connected to the outlet of a low pressure pump not shown, the rotary part of which is conveniently driven from the distributor member. The low pressure pump is also provided with a valve whereby its output pressure varies in accordance with the speed at which the distributor member is driven.

In the position shown the inlet passage 21 is in communication with the inlet port 22 and a groove 27 is in communication with the passage 26 hence the output pressure of the low pressure pump is applied to the outer end of the shuttle 24 which is therefore moved inwardly to displace the measured volume of fuel. As the distributor member rotates the inlet passage 21 is moved out of register with the port 22 and a groove 27 moves into register with the port 22 whilst a groove 28 moves into register with the port defined at the end of the passage 26. The shuttle therefore is subjected to pressure at its inner end and it is moved outwardly into contact with the stop 25.

The angular setting of the cam ring about the axis of rotation of the distributor member determines the timing of delivery of fuel to the associated engine.

Figure 2:
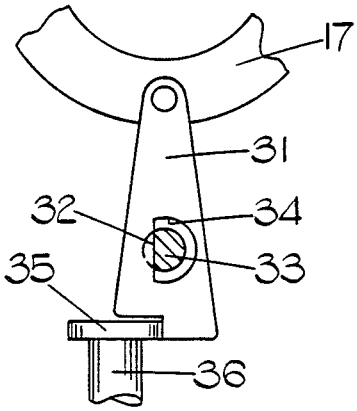
FIG. 2 is a practical embodiment of part of the apparatus seen in FIG. 1.

As shown in FIG. 1 the cam ring 17 has pivotally connected thereto an arm 31 which extends outwardly from the cam ring in a plane perpendicular to the axis of rotation of the distributor member 12. At one point spaced from its pivotal connection with the cam ring 17, the arm engages a shaped surface 32 defined on an actuating member 33. The actuating member is shown diagrammatically in FIG. 1 but as shown in FIG. 2, it extends generally parallel to the axis of rotation of the distributor member and is movable axially along its length. The actuating member extends through an aperture 34 formed in the arm 31, the aperture having a surface engaging with the aforesaid surface 32. At a second position the arm 31 engages with a cam 35 shown diagrammatically in FIG. 1 but shown in FIG. 2 as being mounted on an angularly adjustable shaft 36. The axial setting of the actuating member 33 is determined by a speed responsive means 33A. This can comprise a piston to which is applied the output pressure of the aforesaid low pressure pump or it may be an electromagnetic device the power to which is determined by an engine speed conscious electrical circuit. The setting of the shaft 36 is determined by an engine operator and in the case where the engine is a vehicle engine the shaft 36 can be directly connected to the throttle pedal of the vehicle. In FIG. 1 the direction of rotation of the distributor member is in the anti-clockwise direction and the cam ring is biased in the same direction by a coiled tension spring 37. The purpose of the spring 37 is to prevent movement of the cam ring in the clockwise direction when the rollers 19 have moved over the crests of the cam lobes. In operation as the speed of the associated engine increases the actuating member 33 is moved downwardly as shown in FIG. 1 and this causes the cam ring 17 to be moved against the action of the spring 37. This results in an advancement in the timing of delivery of fuel to the associated engine. Conversely when the actuating member 33 is moved upwardly, the spring 37 causes the cam ring to move in the anti-clockwise direction thereby the timing of delivery of fuel to the associated engine is retarded. Angular movement of the shaft 36 through the intermediary of the cam 35, also influences the position of the cam ring so that the timing of delivery of fuel is varied as the demand on the engine by the operator, varies.

There is also provided on the shaft 36 a further cam 39 and this is shown in FIG. 1. Also provided is a lever 40 which is pivotally mounted at one end on an adjustable support 41 and which has a projection 42 for engagement with the cam 39. A further projection 43 is formed on the lever 40 for engagement with the aforesaid stop 25 the latter being spring loaded into engagement with the projection 43 by means of a coiled compression spring 44. In operation, as the shaft 36 is moved by the operator in the direction to increase the amount of fuel supplied to the engine, the cam 39 allows the lever 40 to move in the anti-clockwise direction as shown in FIG. 1 thereby allowing the stop member 25 to move outwardly under the action of the spring 44 thereby allowing the shuttle 24 an increased range of movement. Conversely if the driver releases the throttle pedal springs associated therewith will move the shaft 36 in a direction such that the lever 40 is moved in the clockwise direction thereby moving the stop member 25 inwardly to reduce the stroke of the shuttle 24 thereby reducing the amount of fuel supplied to the engine. In the particular arrangement it is arranged that when the throttle pedal is released by the operator the stop member moves inwardly to the extent that the shuttle 24 can no longer partake of movement within its bore. As a result no fuel will be supplied through the filling port 22. It is necessary however as the engine speed falls and approaches the normal idling speed to supply fuel to the engine in order that it can idle and this supply of fuel is achieved by apparatus to be described.

Returning to FIG. 1 it will be observed that the lever 40 has an extension mounting a further projection 45 positioned adjacent a shaped surface 46 formed on the actuating member 33. The surface 46 is shaped so that as the speed of the associated engine increases the surface 46 will engage with the projection 45 to move the lever in the clock-wise direction thereby reducing the amount of fuel supplied to the engine. Thus a governing action is obtained. The surface is also shaped to control the maximum amount of fuel which can be supplied to the engine over the speed range. The surface becomes effective in this regard if the cam 39 is set so that the maximum amount of fuel is supplied to the engine.

As stated above when the shaft 36 is moved to a position in which the movement of the shuttle 24 is prevented no fuel is supplied to the bore 13 and therefore no fuel is supplied to the associated engine. It is however necessary to arrange for fuel to be supplied to the engine for idling purposes and with reference to FIG. 3 a separate valve is provided which also acts as an hydraulic governor to control the idling speed of the engine. A valve member is shown at 47 and it is slidable within a bore 48 formed within the sleeve 11. Both ends of the bore are closed by respective plugs. The valve member is loaded by means of a coiled compression spring 49 towards the left hand end of the bore as seen in FIG. 3 and the right hand end of the bore is placed in communication with the interior of the housing of the apparatus. Formed in the periphery of the valve member is a circumferential groove 50 which is in constant communication with the circumferential groove 29 formed in the distributor member by way of a suitable port 51. Moreover, the groove 50 by way of a drilling formed in the valve member, communicates with the left hand end of the bore so that the output pressure of the aforesaid low pressure pump can be applied to the left hand end of the valve member to urge the valve member against the action of the spring 49. A further port 52 is formed in the sleeve at a position to register with one of the inlet passages 21 at the same time as another of the inlet passages 21 is in register with the port 22. The port 52 opens into the bore 48 at a position so that it can communicate with the circumferential groove 50.

The operation of the valve member will now be described assuming firstly that the engine is at rest. In this condition there will be no pressure applied to the left hand side of the valve member and hence it will be urged towards the left hand end of the bore 48 as seen in FIG. 3. In this position the port 52 has full communication with the groove 50 so that when the engine is cranked for starting purposes, irrespective of the position of the throttle control of the vehicle, the bore 13 will be completely filled with fuel and the quantity of fuel which will be supplied to the engine will be greater than the normal maximum quantity which can be supplied as determined by the surface 46 on the actuating member 33. When the engine starts the output pressure of the aforesaid pump will build up and the valve member 47 will be moved towards the right against the action of the spring 49. Such movement will partly obturate the port 52 and a reduced amount of fuel will be supplied to the engine. The valve member being responsive to the engine speed will act as an hydraulic governor. If whilst the engine is idling, the throttle pedal of the engine is depressed, the shuttle 24 will start to function and fuel will be supplied to the bore 13 in the manner described. The engine will therefore accelerate and the increased speed will cause an increase in the pressure applied to the left hand end of the valve member which will move further against the action of the spring 49 to close the port 52. Hence no fuel will be supplied through the port 52 to the bore 13 and the apparatus will operate as described above. It will be appreciated that when the engine is running at high speed and the throttle pedal is released then no fuel will be supplied to the bore 13 until the engine speed has fallen to a value sufficient to partly uncover the port 52 to the groove 50.

Figure 4:
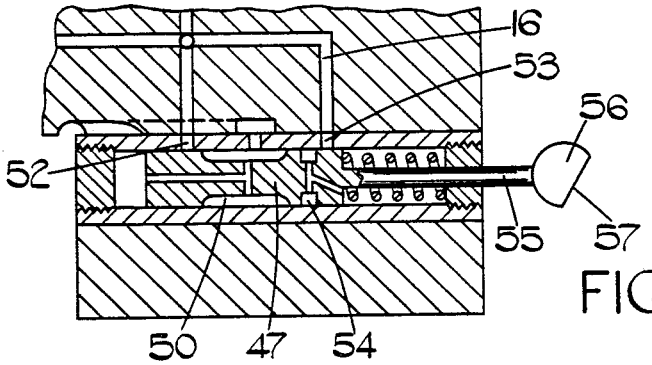
FIGS. 4 and 5 show modification to parts of the apparatus shown in FIG. 3.

It was stated above that when the throttle pedal is released and the port 52 is covered by the valve member, that no fuel is supplied to the bore 13. This is perfectly correct but in practice small quantities of fuel do continue to be supplied to the engine. This is because at the end of the delivery stroke there is a residual pressure within the various passages in the distributor member and which are connected to the bore 13 so that even when no fuel is supplied to the bore 13 slight inward movement of the plungers takes place such movement occuring late in what would be regarded as the normal delivery cycle. This small quantity of fuel is delivered to the combustion chambers of the engine and for various reasons does not burn properly so that puffs of smoke appear in the engine exhaust. This smoke is particularly objectionable since it contains unburnt fuel. In order to avoid this problem and as shown in FIG. 4, a further port 53 is formed in the sleeve 11 and positioned to register with the delivery passage 16 once per revolution of the distributor member. Moreover, formed on the periphery of the valve member 47 is a circumferential groove 54 which is in constant communication with the right hand end of the bore 48. In this case this end of the bore is connected to a drain and not as in the previous case, to the space within the housing which as is the usual practice, is maintained under pressure by means of a suitable valve.

The valve member 47 is also provided with an extension 55 which extends through the end plug of the bore into contact with a cam 56. The cam 56 is mounted on the shaft 36 and is provided with a flat 57. The flat 57 is brought into register with the extension 55 when the throttle pedal of the vehicle is released. In FIG. 4 the valve member is shown in the position it assumes for normal operation of the associated engine. In order words fuel is being supplied to the associated engine under the control of the shuttle 24. If now the throttle pedal of the vehicle is released the cam 56 will move angularly so that the flat 57 is presented to the extension 55 and under the action of the fuel pressure in the left hand end of the bore 48 the valve member 47 will move further towards the right to bring the groove 54 into alignment with the port 53. When the delivery passage 16 moves into register with the port 53 then the pressure acting upon the outer ends of the plungers 14 will move them inwardly their maximum extent the fuel displaced by the plungers flowing by way of the delivery passage 16, the port 53 and the groove 54 to the right hand end of the bore 48 which as already stated, is connected to a drain. The plungers therefore will never be actuated by the cam lobes and the supply of fuel to the associated engine will be completely cut off. As the throttle pedal is depressed the valve member 47 will be moved towards the left thereby moving the groove 54 out of communication with the port 53. Fuel will be supplied to the bore 13 under the control of the shuttle 24. The valve member 47 operates as described as a governor to control the idling speed of the engine and also to provide the additional quantity of fuel for starting purposes.

Figure 5:
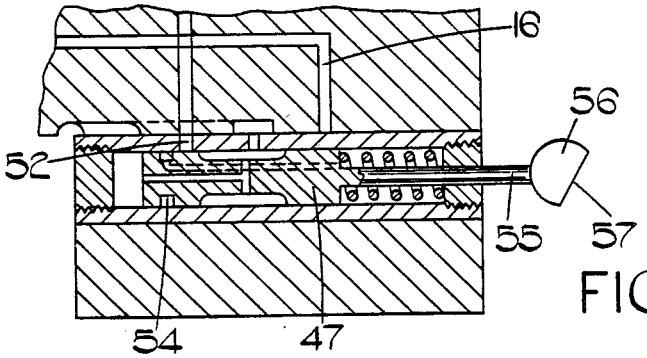

A modification of the arrangement shown in FIG. 4 is shown in FIG. 5 and in this case it will be noted that the circumferential groove 54 is disposed on the left hand side of the groove 50. Moreover, the port 53 is omitted and the groove 54 when the extension 55 is in engagement with the flat 57, registers with the port 52. The practical effect is the same as described with reference to the example of FIG. 4.

I claim:

1. A fuel injection pumping apparatus for supplying fuel to an internal combustion engine and comprising a rotary member adapted to be driven in use, in timed relationship with the associated engine, a plunger located in a bore formed in the rotary member, an angularly adjustable cam member for imparting inward movement to the plunger as the rotary member rotates, means for conveying fuel displaced from said bore to an outlet, said cam being angularly movable to vary the timing of delivery of fuel from said bore, a shuttle movable in a cylinder to displace fuel from the cylinder to the bore to effect outward movement of the plunger, means for controlling the displacement of the shuttle thereby to vary the amount of fuel supplied to the outlet during inward movement of the plunger, an arm pivotally connected to and extending from said cam member in a plane generally perpendicular to the axis of rotation of said rotary member, an actuating member movable along an axis generally at right angles to said plane, a shaped surface defined on said actuating member for engagement by said arm whereby as the actuating member is moved axially angular movement will be imparted to the arm and the cam member, means responsive to the speed at which the apparatus is driven for varying the axial setting of said actuating member and an adjustable cam engageable with said arm at a position removed from its pivotal connection with the cam member, the setting of an operator adjustable control.

2. An apparatus according to claim 1 in which the means for controlling the displacement of the shuttle comprises a further adjustable cam the setting of which is dependant upon the setting of said operator adjustable control, a pivotal lever, said lever being movable by said further adjustable cam, and a stop for said shuttle the position of said stop being determined by the position of said lever.

3. An apparatus according to claim 2 including a further surface on said actuating member, said lever being engageable by said further surface upon movement of the actuating member with increasing speed to effect movement of the lever in the direction to reduce the travel of the shuttle.

4. An apparatus according to claim 3 in which said actuating member extends at right angles to said arm and passes through an aperture therein.

5. An apparatus according to claim 3 including hydraulic governor means operable to control the supply of fuel by the apparatus at engine idling speed in the event that said operator adjustable control is set to prevent movement of the shuttle.

6. An apparatus according to claim 5 in which said hydraulic governor means comprises a valve member slidable within a bore, resilient means biassing the valve member, means for conveying liquid under pressure to the bore so as to move the valve member against the action of said resilient means by an amount determined by the speed of operation of the apparatus, co-operating port means on the valve member and in the wall of the bore through which fuel can be supplied to the bore containing the plunger, said co-operating port means acting as a throttle to control the flow of fuel.

7. An apparatus according to claim 6 including a stop operable to limit the extent of movement of the valve member against the action of said resilient means, said stop being effective to halt said valve member after said port means has been closed, said stop being moved to an inoperative position to allow further movement of the valve member, when said operator adjustable control has been moved to a position to prevent movement of said shuttle said valve member when in said further position connecting the bore containing the plunger with a drain.

* * * * *